US006729862B1

(12) United States Patent
Schnabl

(10) Patent No.: US 6,729,862 B1
(45) Date of Patent: May 4, 2004

(54) ROTARY PISTON MACHINE

(76) Inventor: Peter Schnabl, Waldrebenstrasse 4, 80935 München (DE)

( * ) Notice: Subject to any disclaimer, the term of this patent is extended or adjusted under 35 U.S.C. 154(b) by 0 days.

(21) Appl. No.: 10/129,343

(22) PCT Filed: Nov. 3, 2000

(86) PCT No.: PCT/EP00/10831

§ 371 (c)(1),
(2), (4) Date: May 2, 2002

(87) PCT Pub. No.: WO01/33047

PCT Pub. Date: May 10, 2001

(30) Foreign Application Priority Data

Nov. 4, 1999 (DE) ..... 199 53 168

(51) Int. Cl.[7] ..... F01C 3/00
(52) U.S. Cl. ..... 418/68; 418/182
(58) Field of Search ..... 418/68, 182

(56) References Cited

U.S. PATENT DOCUMENTS 1,430,602 A * 10/1922 Sykora ..... 418/68
2,517,279 A 8/1950 Benzler
3,667,876 A * 6/1972 Boyd ..... 418/68

FOREIGN PATENT DOCUMENTS

DE 27 33 574 2/1979
EP 0 843 974 A1 5/1998
GB 27071 * 4/1916 ..... 418/68
WO WO 80/00599 4/1980
WO WO 91/05940 5/1991

* cited by examiner

*Primary Examiner*—Thomas Denion
*Assistant Examiner*—Theresa Trieu
(74) *Attorney, Agent, or Firm*—McCormick, Paulding & Huber LLP

(57) ABSTRACT

The invention relates to a rotary piston machine, comprising a housing (10) and a piston (12) which is situated in a hollow area of the housing (10) in such a way that it can rotate and which is rotationally fixed to a shaft (18) that passes through the housing (10). At least one inlet channel and at least one outlet channel for guiding a working fluid in or out of the hollow area are configured in the housing (10). According to the invention, the hollow area has a section which is configured in the form of a cylindrical ring cavity that is coaxial to the shaft (18). The piston (12), as a ring piston, is configured in the form of a cylindrical tubular section which engages in the ring cavity of the housing (10) and is axially displaceably guided in said ring cavity. The end surfaces (20,26) of the ring cavity and the ring piston (12) facing away towards each other are configured as constant wavy surfaces with an axially parallel amplitude. The inlet and outlet openings are located within an axial area of the lateral surface of the ring cavity that is determined by the maximum axial interval of the wave hollows of the end surfaces (20,26) facing towards each other.

14 Claims, 15 Drawing Sheets

ROTARY PISTON MACHINE

CROSS REFERENCE TO RELATED APPLICATIONS

Applicant hereby claims foreign priority benefits under 35 U.S.C. §119 of German Patent Application No. 199 53 168.4 filed Nov. 4, 1999 and PCT Application No. PCT/EP00/10831, filed Nov. 3, 2000, the disclosure of which is herein incorporated by reference.

FIELD OF THE INVENTION

The invention concerns a rotary piston machine with a housing and a piston, which piston is rotatably arranged in a hollow space of the housing and is rotatably fixedly connected with a shaft passing through the housing, with at least one inlet channel and one outlet channel being provided in the housing for the delivery and exhaust of a working fluid to and from the hollow space.

BACKGROUND OF THE INVENTION

The invention has as its object the provision of a rotary piston machine of the above-mentioned kind which is of simple construction and in which the inlet and outlet openings for the working fluid can be controlled in a simple way.

SUMMARY OF THE INVENTION

This object is solved in accordance with the invention in that the hollow space has a section in the form of a cylindrical annular space co-axial to the shaft, that the piston is formed as a annular piston in the shape of a cylindrical tube section which is received in the annular space of the housing and is guided for axially shifting movement in the annular space of the housing, and in that the end surfaces of the annular space and of the annular piston which face one another are formed as continuous wave surfaces with amplitudes directed parallel to the machine axis, so that the inlet and outlet openings lie inside of an axial region of the lateral annular space surface, which region is defined by the maximum axial spacing of the wave hollows of the end surfaces facing one another.

The rotary piston machine according the invention can be driven as a pump or, in so far as the wave surfaces of the annular space and of the ring piston are formed with at least two wave crests and wave hollows over 360° of the circumference, also as a motor. In general the machine is so formed that the housing remains stationary and the piston rotates with the shaft. In principle, however, it is possible to also use the opposite arrangement, in which the housing rotates relative to the non-rotating piston. However, in this case the connections for the delivery and the exhaust of the working fluids become complicated. The piston can be axially slidably supported on the shaft or can be rigidly connected with the shaft, in which case the shaft is axially slidably supported in the housing.

In the inventive solution, the working space of the rotary piston machine forms variable hollow spaces between the end surfaces of the annular space and of the annular piston which slide on one another. Each hollow space expands or diminishes in size during the rotation and the axial oscillating movement of the piston relative to the housing. The inlet opening and outlet opening can be so arranged in the radially outer or radially inner lateral boundary surfaces of the annular space that they are cyclically opened and again closed by the piston wall, in order in the case of a pump for example to suck in a working fluid and again expel it, or in the case of a motor to suck in a fuel mixture, to compress the mixture and subsequently to exhaust the combustion gases.

Since the annular piston is formed rotationally symmetrical with respect to its rotation axis, a completely smooth running of the piston is obtained. The same applies also in the case of a rotational housing. No essential sealing problems appear. Movable valves for the opening and closing of the inlet and outlet openings are not required.

Preferably the inlet opening and the outlet opening are so arranged that in the circumferential direction one of the openings lies in front of and the other lies behind a wave crest of the end surface of the annular space. In this construction of the rotary piston machine as a motor, on a circumference of 360° one inlet opening and one outlet opening are provided. In the construction of the rotary piston machine as a pump preferably two inlet openings and two outlet openings are provided for each end surface of the piston.

One of the end surfaces can be formed so as to have an at least nearly sinusoidal shape. The other end surface is preferably so designed that an axial movement of the piston of maximum uniformity is achieved during one revolution and no jerking or extreme acceleration of the piston in the axial direction appears.

In a first embodiment of the invention the piston is biased in the axial direction, for example by a spring, so that its end surface constantly lies on the end surface of the associated annular space. The force by which the surfaces are pressed together can also be regulated by the pressure fluid in the annular space.

In another embodiment, in a lateral surface of the piston or of the annular space a groove is formed in which is received a guide element connected to the other part (annular groove, piston), so that the path of the groove in the circumferential direction corresponds to the wave shape of the end surface of the annular space. Thereby the translational movement of the piston and of the cylinder relative to one another is controlled by the groove. The end surfaces of the piston and the annular space need not contact one another, so that wear of these surfaces by sliding on one another is avoided.

Another solution, for reducing the wear of the end surfaces by sliding friction exists in that in one of the end surfaces of the annular space and piston facing one another, at least one guide element is rotatably supported for rolling on the other end surface.

In a further embodiment of the invention, two annular space/annular piston arrangements of the previously described kind are arranged coaxial to one another so that the two pistons arranged on the same shaft move in common between the end surfaces of the two annular spaces.

For example, the two pistons can be unified into a one piece double piston. In this case the two end surfaces of the hollow space or of the two joined together hollow spaces are so arranged relative to one another that the maximums and minimums of their wave surfaces lie on the same generatrix of the cylindrical lateral surface of the hollow space. Thereby it can be assured that the two end surfaces of the rotating annular piston constantly slide uniformly on the two end surfaces of the hollow space when the piston rotates.

BRIEF DESCRIPTION OF THE DRAWINGS

The following description explains the invention by way of exemplary embodiments in connection with the accompanying drawings. The drawings are.

DETAILED DESCRIPTION OF THE PREFERRED EMBODIMENTS

Figure 1:
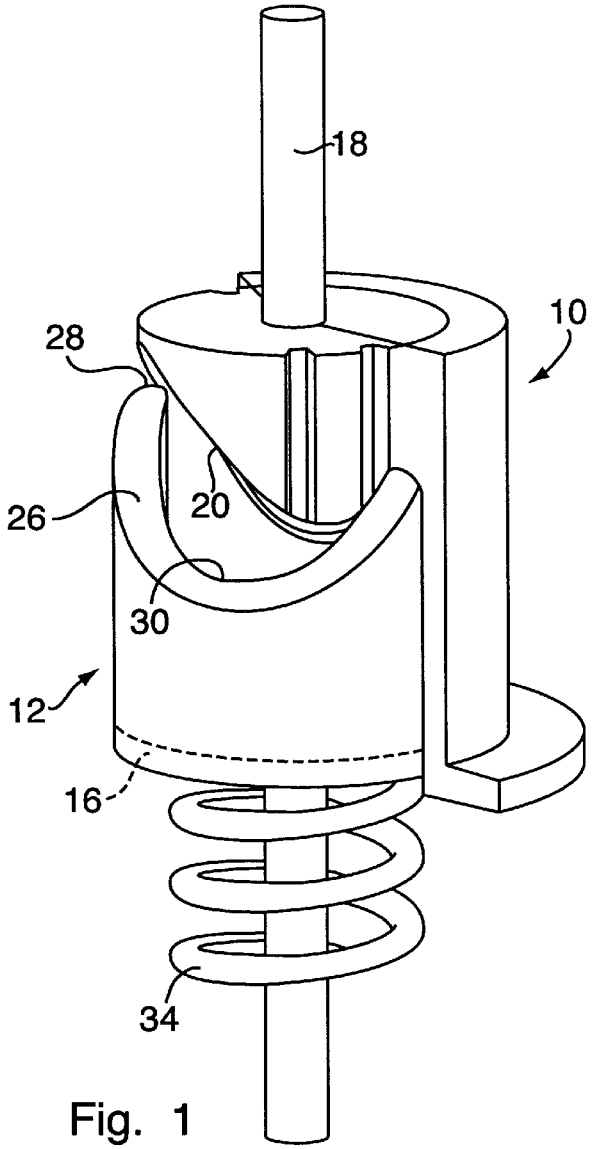
FIG. 1 a schematic, perspective, partially broken away illustration of a first embodiment of a rotary piston machine in accordance with the invention with one piston/annular space arrangement, FIG. 2 a sectional view containing the axis taken through the housing of the arrangement illustrated in FIG. 1, FIG. 3. a schematic, perspective, partially broken away illustration of a rotary piston machine with a double piston, FIG. 4. a schematic, axis containing sectional view taken through the double-piston arrangement of FIG. 3, FIG. 4*a* the detail A of FIG. 4 in an enlarged scale for a modified embodiment of the invention, FIGS. 5–10 each a developed illustration of the end surfaces of the housing hollow space and of the double piston which slide on one another of a double-piston machine according to FIGS. 3 and 4 operating as a motor, and FIGS. 11–16 figures corresponding to FIGS. 5 to 10 illustrating a double-piston machine which is driven as a pump.
Figure 2:
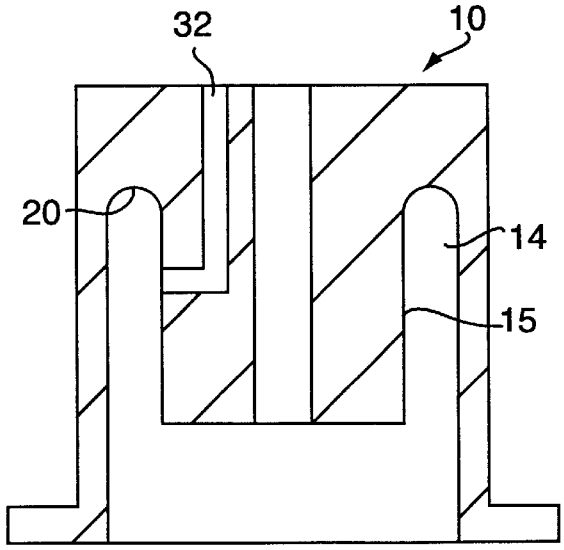
Figure 4:
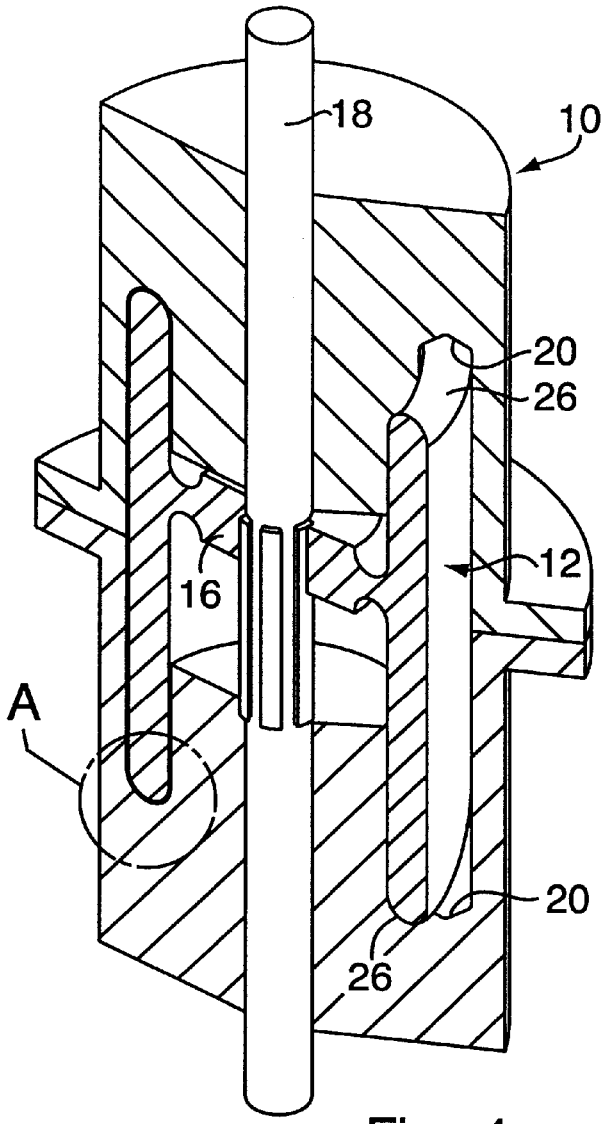

The rotary piston machine illustrated in FIGS. 1 and 2 includes a cylindrical housing 10 and a annular piston 12 made in the form of a tubular section, which is rotable in an annular shaped hollow space 14 of the cylindrical housing 10 and is guided so as to be axially shiftable. The piston is rotatably fixed to a shaft 18 by a radial base, which is indicated in FIG. 1 by broken lines at 16, or by radial spokes, but is axially shiftable on the shaft 18 which passes through the housing 10. One such an axially shiftable and rotatably fixed connection can for example be achieved by way of splines, as illustrated in FIG. 4.

The annular space 14 has an annular shaped end surface 20, which can have a straight or curved cross-section and which in the circumferential direction has a waved-shaped path with a wave amplitude parallel to the machine axis. As can be recognized from FIGS. 5–10, the wave path is nearly sinusoidal and in the illustrated example has two wave crests or maximums 22 as well two wave hollows or minimums 24.

The front or end surface 26 of the annular piston 10 facing the end surface 20 of the annular space 14 is likewise formed with a wave-shaped path, as seen FIG. 1. This end surface also has two maximums or wave crests 28 and two wave hollows 30 (FIGS. 5–10). This wave path is, however, so formed that the half width of a wave crest as measured in the circumferential direction, that is, the width of a the wave crest in the axial middle between one wave minimum and one wave maximum is smaller than the half width of a wave hollow. The arrangement can also selectively be reversed in so far as the end surface 26 of the annular piston can be selected to be sinusoidal and the end surface 20 of the annular space 14 can have a smaller wave crests and wider wave hollows.

FIG. 2 shows further one of the inlet and outlet channels 32 in the housing 10, which terminate at the inner boundary wall 15 of the annular space of 14 and serve to deliver or carry away a working fluid to or from the annular space of 14, as is explained in more detail in connection with FIGS. 5–16.

The piston 12 is biased by a helical spring 34 arranged coaxial to the shaft 18 against the end surface 20 of the annular space of 14. Instead of the helical spring, a plate spring can also be used, which at the same time can serve to connect the piston rotatably fast to the shaft. With such plate spring the axial construction length is shortened.

Figure 3:
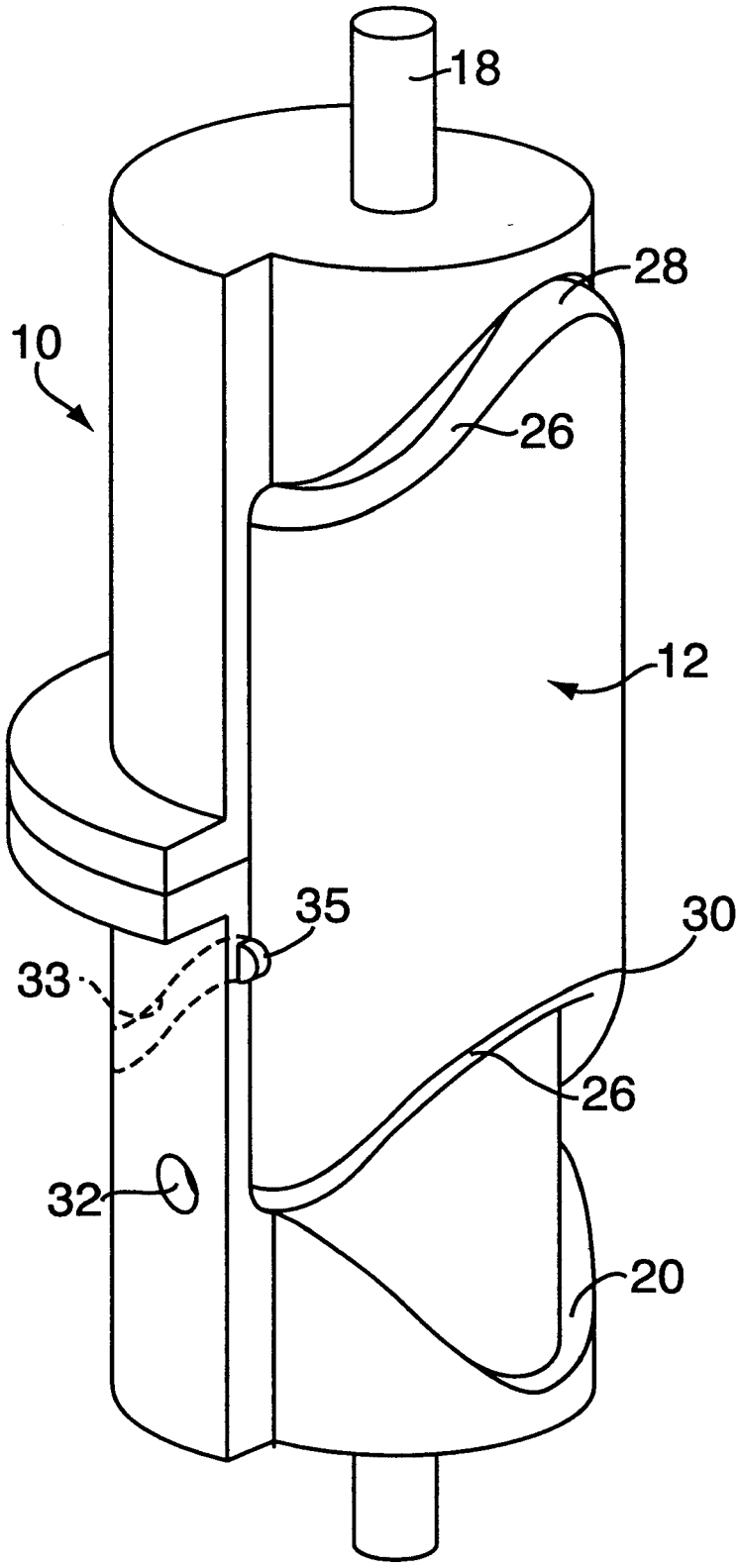

In the embodiment of the rotary piston machine according to the invention illustrated in FIGS. 3 and 4, two piston/housing arrangements of the type illustrated in FIG. 1 are arranged coaxial to one another, in which case the spring 34 is not present. The two pistons are unified into a single double-piston, with similar parts in these figures being designated with the same reference numbers as in FIGS. 1 and 2.

The arrangement of the end surfaces 20 of the annular spaces 14 is so chosen that the maxima and the minima of the two end faces 20 each lie on a common generatrix of the cylindrical annular space 14, as also seen in FIGS. 5 to 16.

The end surfaces 26 of the double-piston 12 on the other hand are so formed that the maximum or wave crest 28 of one end face lies in common with a minimum or wave hollow 30 of the opposite end face on a generatrix of the cylindrical ring piston 12.

In FIG. 3 a guide groove formed in the radially outer wall of the annular space 14 is indicated at 33, which groove receives a pin 35 fastened to the piston 12. The guide groove in its circumferential direction follows the wave shape of the end surface 20 and thereby so controls the translation movement of the piston 12 without the end surfaces 20 and 26 contacting one another. This solution is however only optional.

Figure 4A:
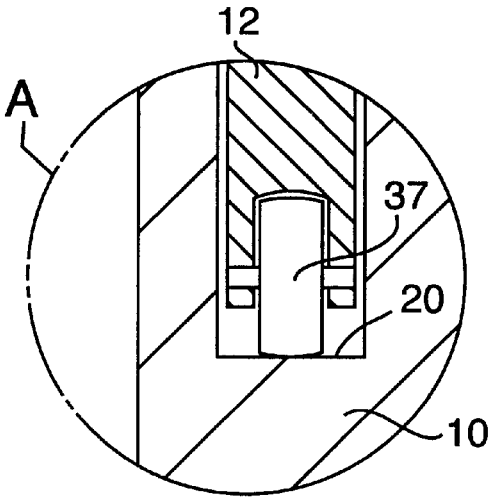

FIG. 4 and FIG. 4*a* shows show yet another possibility for reducing the sliding friction between the end surfaces 20 and 26 and therewith the wear of these surfaces. In a recess in the end surface 26 of the piston 12 a guide element 37 is rotatably supported so that it can roll on the end surface 20 of the annular space. 14.

FIGS. 5–12 concern a rotary piston machine of the type described in FIGS. 3 and 4 driven as a motor, with the functional explanation however likewise applying for the machine according to FIGS. 1 and 2. Each cylinder on a circumference of 360° is provided with one inlet opening 36 and one outlet opening 38, and particularly in such a way, with reference to the circumferential direction of the piston 12 indicated by the direction of the arrow A, that the outlet opening 38 is positioned in front of a wave crest 22 and the inlet opening 36 is positioned after the wave crest 22. The shape of the inlet opening 36 and of the outlet 38 is in practice generally not circular but is shaped according to the application of the rotary piston machine and according to the type of medium flowing through the machine, in order to achieve an optimal control of the medium flow.

Figure 5:
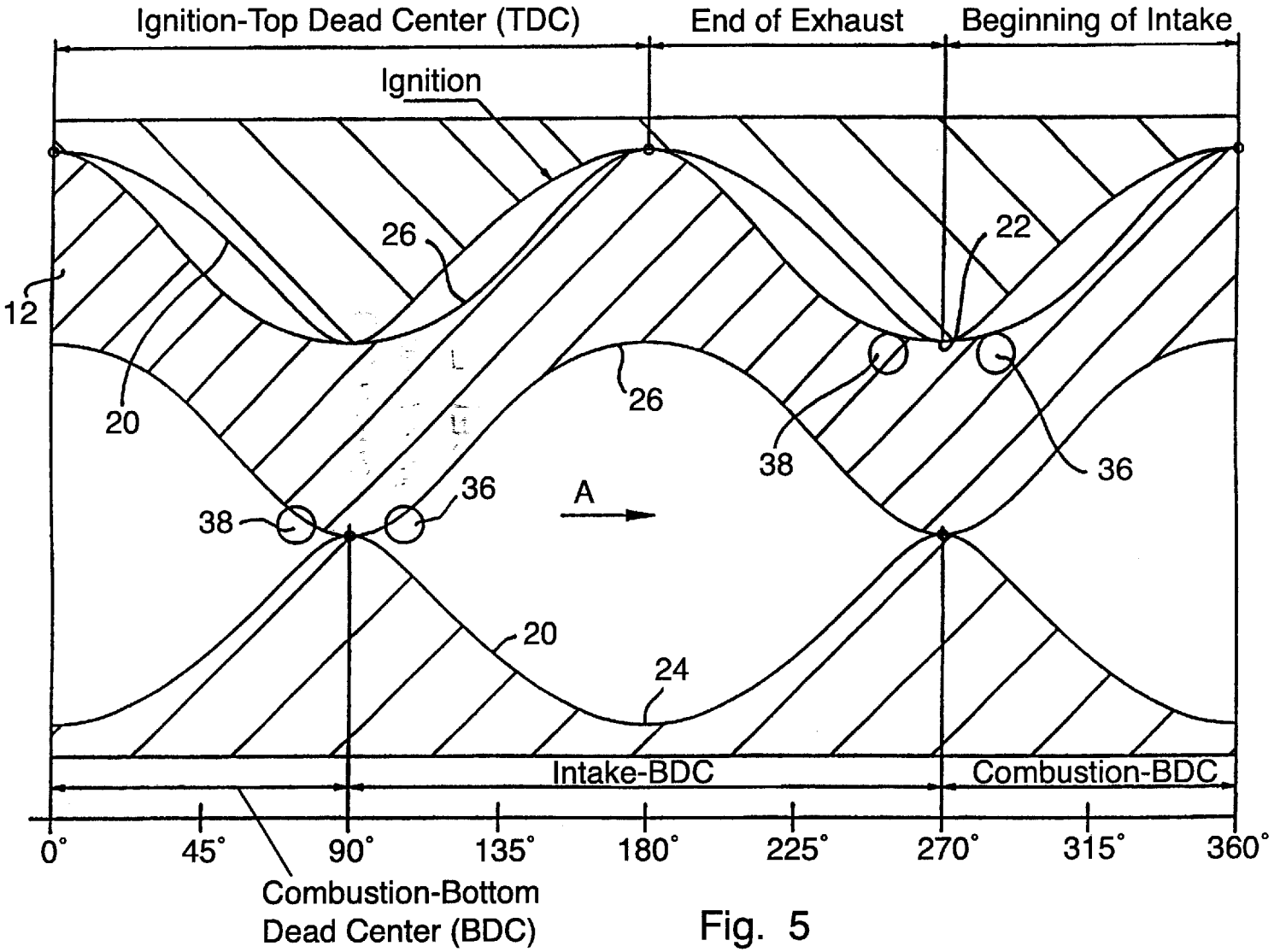

FIG. 5 shows the piston 12 at its upper dead point. In this position four hollow spaces separate from one another are formed between the upper end surface 20 of the annular space 14 and the upper end surface of the piston 12. The hollow space lying between 90° and 180° contains a maximally compressed mixture at the time of ignition. The combustion gases are exhausted from the hollow space lying between 180° and 270°. The outlet opening 38 is closed. Upon a rotation of the piston 12 in the direction of the arrow A, the inlet opening 36 is gradually opened so that mixture is sucked into the hollow space lying between 270° and 360°. On the other hand, in the lower half the ignition space defined in the circumferential direction between 270° and 90° has reached its maximum expansion. The outlet opening 38 is opened. The piston 12 in respect to its lower end surface 20 is located in its lower dead point and the exhaust of the combustion gases from the combustion space begins. In the second hollow space lying between 90° and 270° the mixture sucked in, which now upon further rotation of the piston becomes compressed.

Figure 6:
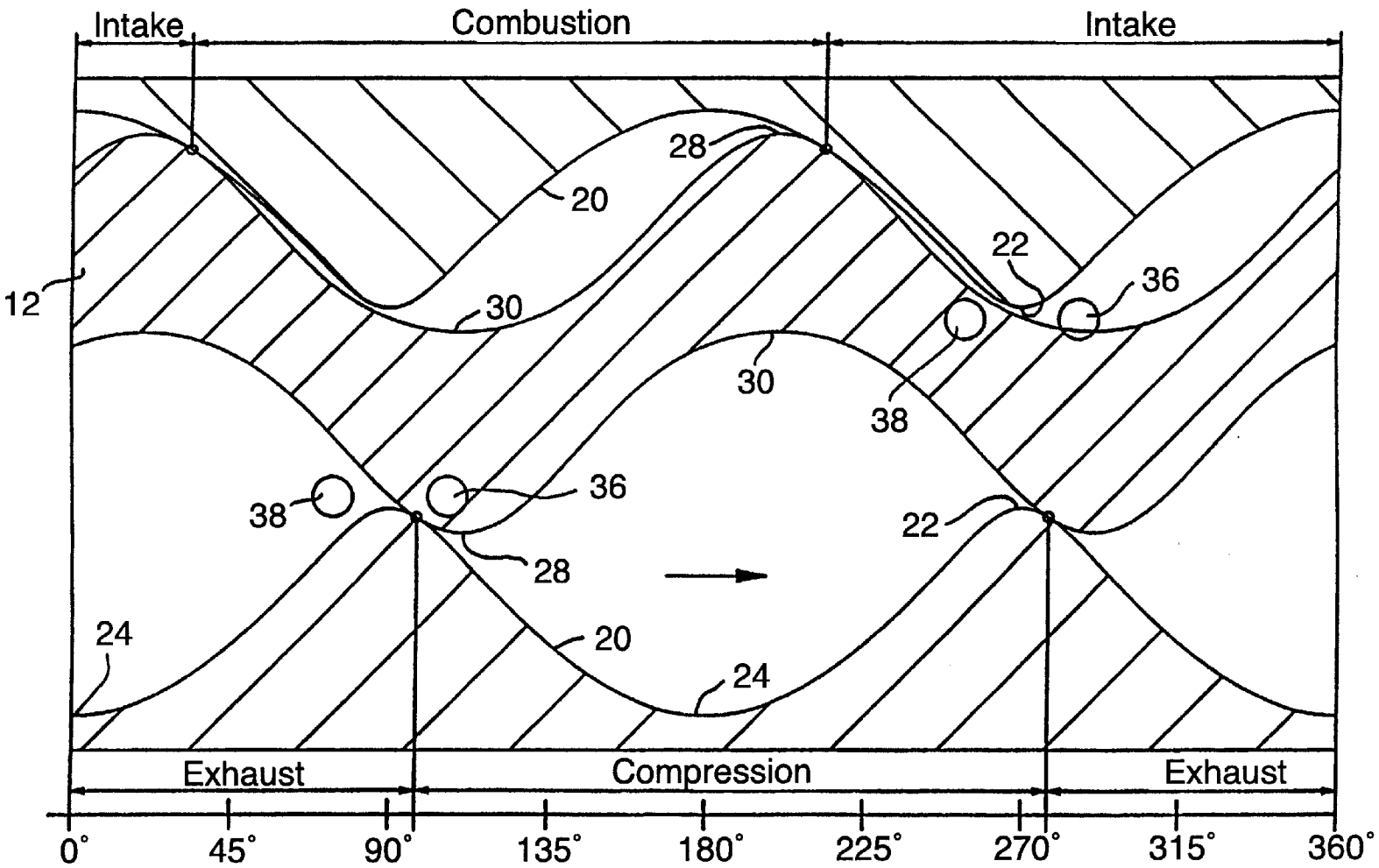
Figure 7:
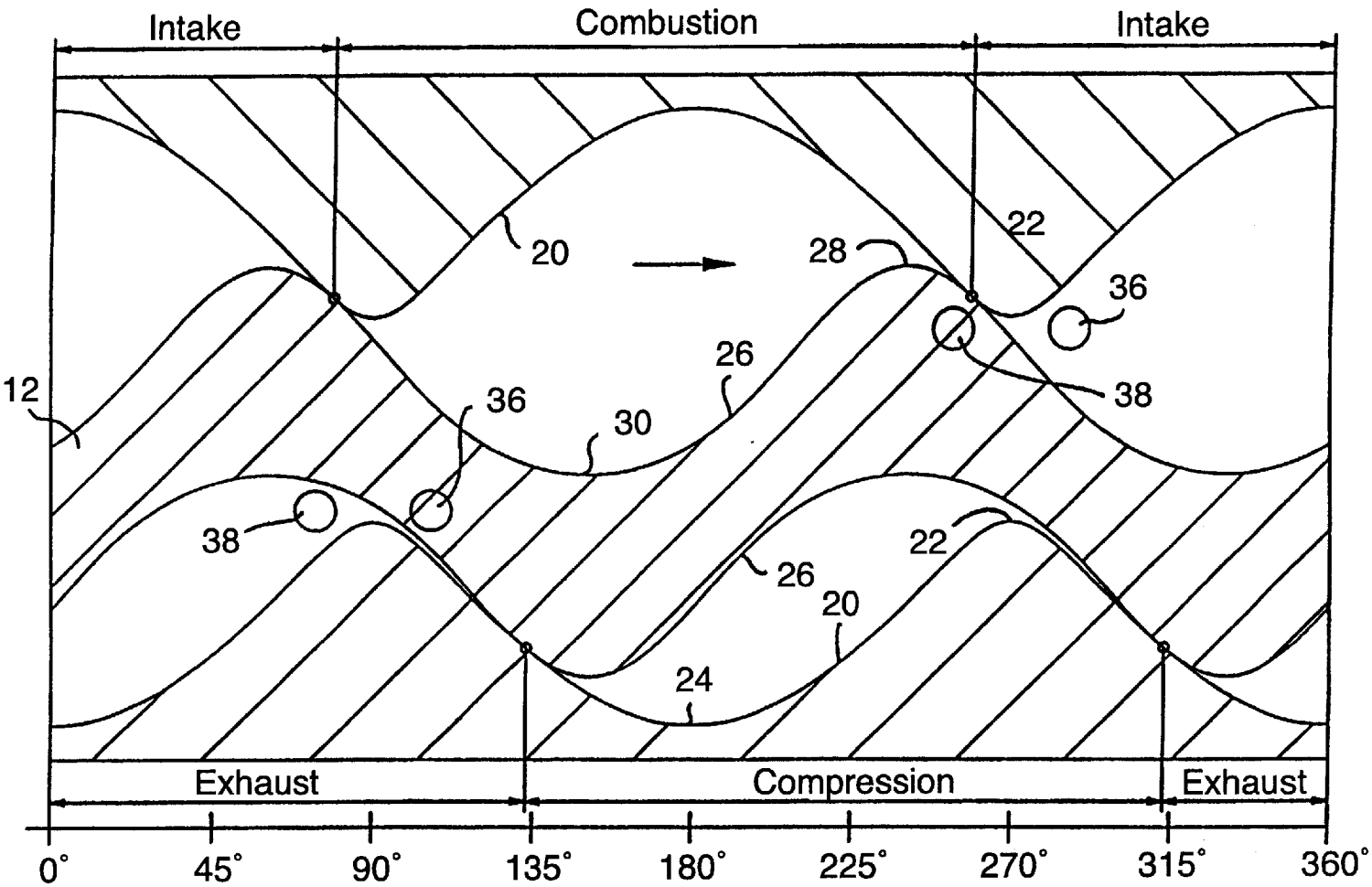
Figure 8:
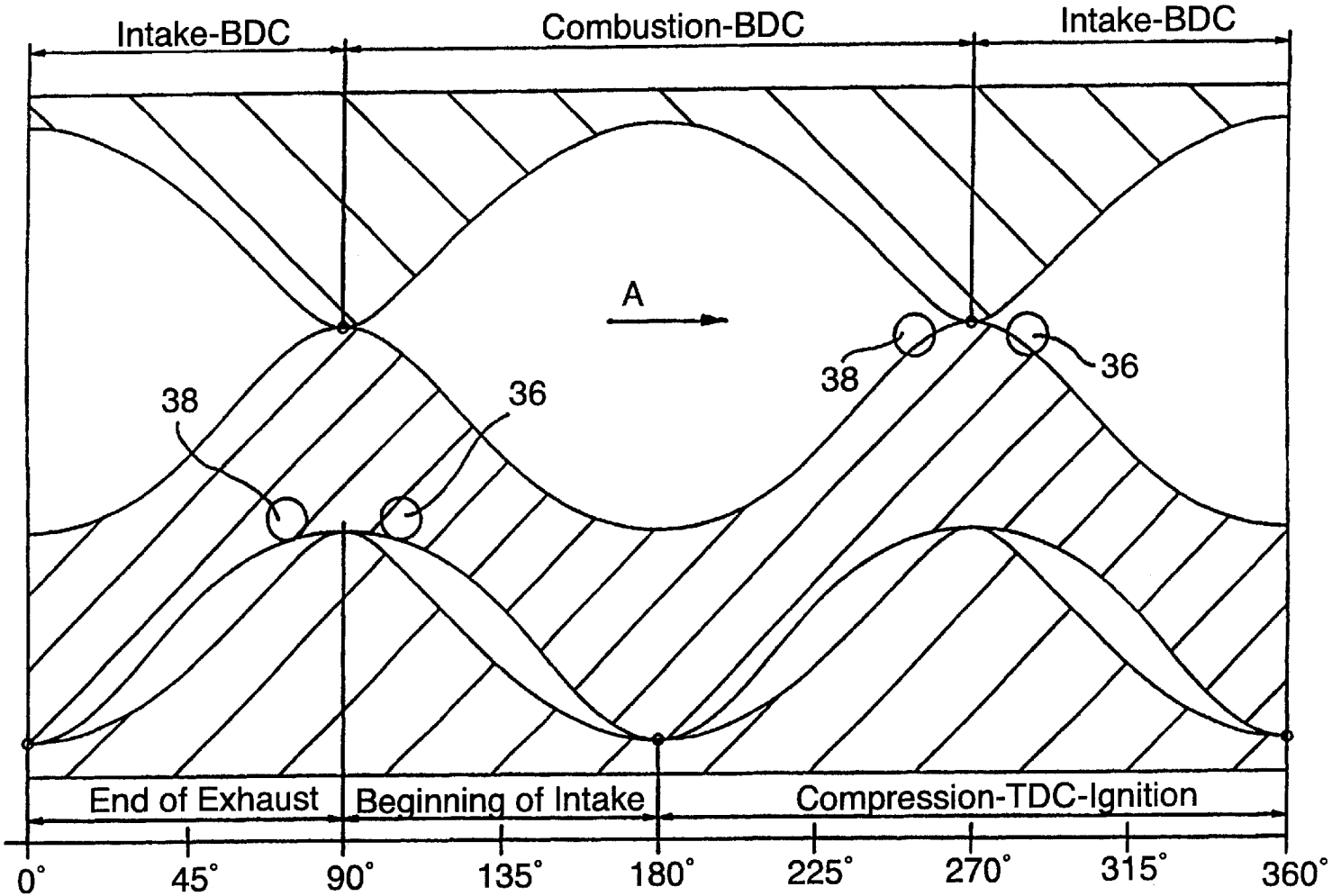
Figure 9:
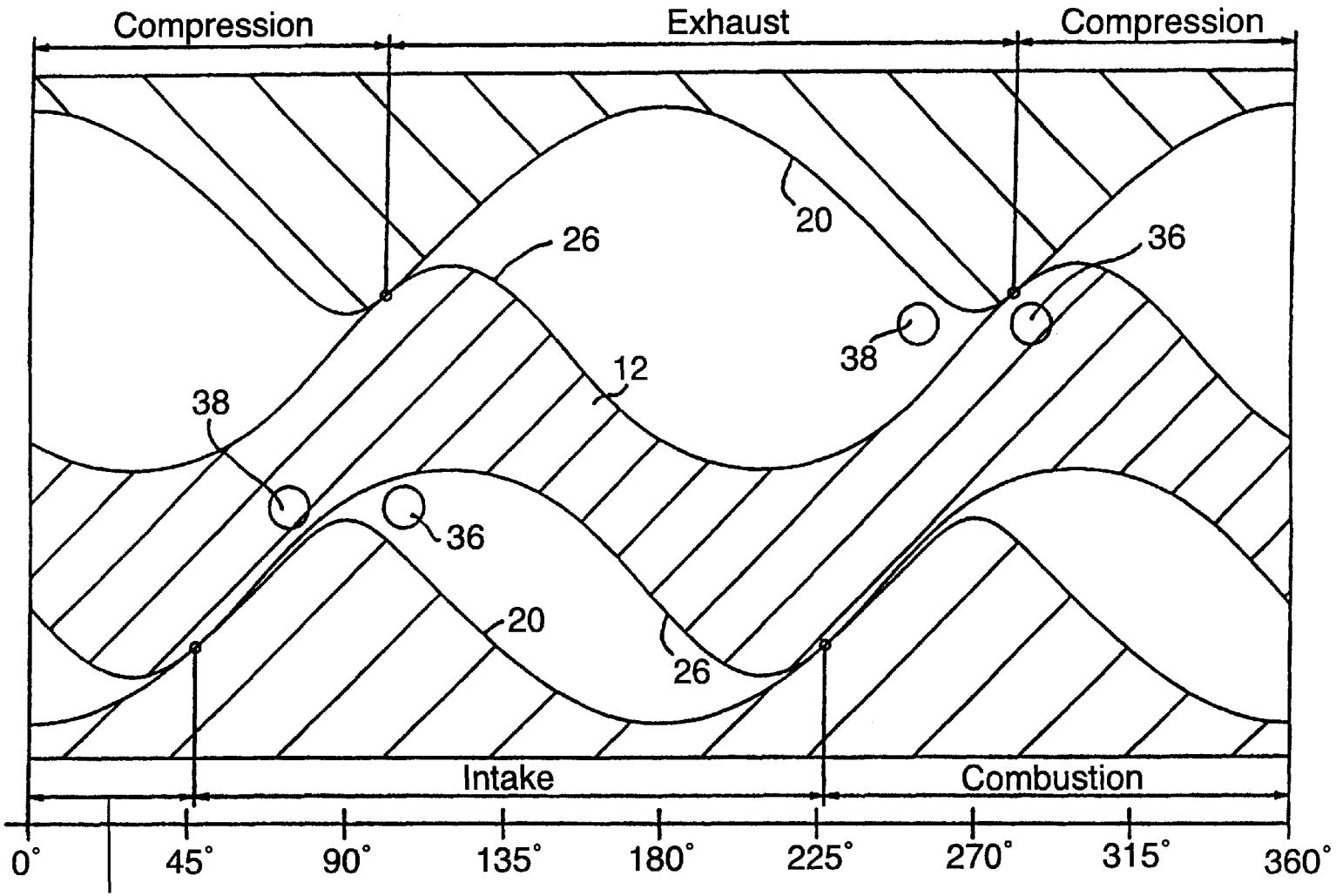
Figure 10:
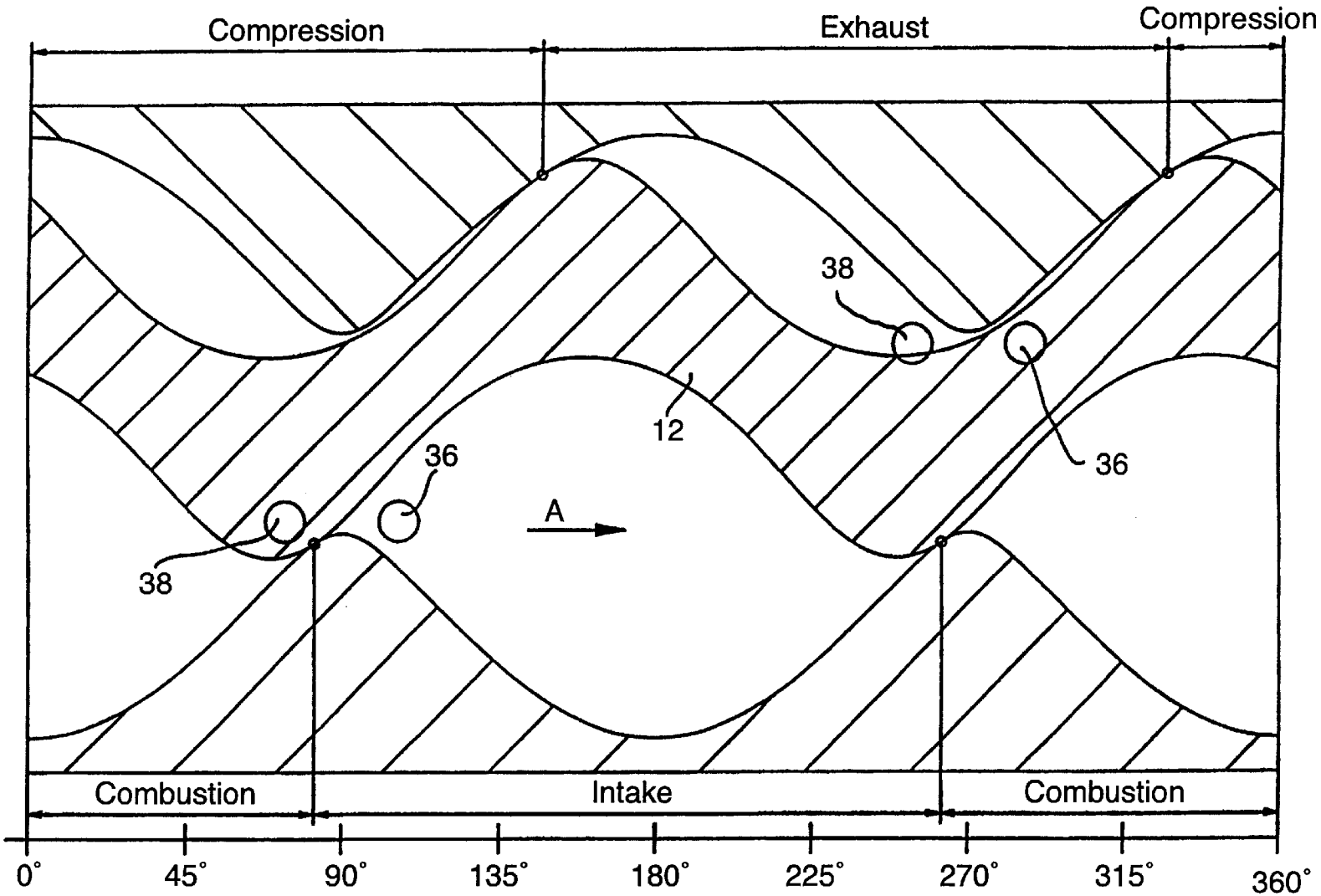
Figure 11:
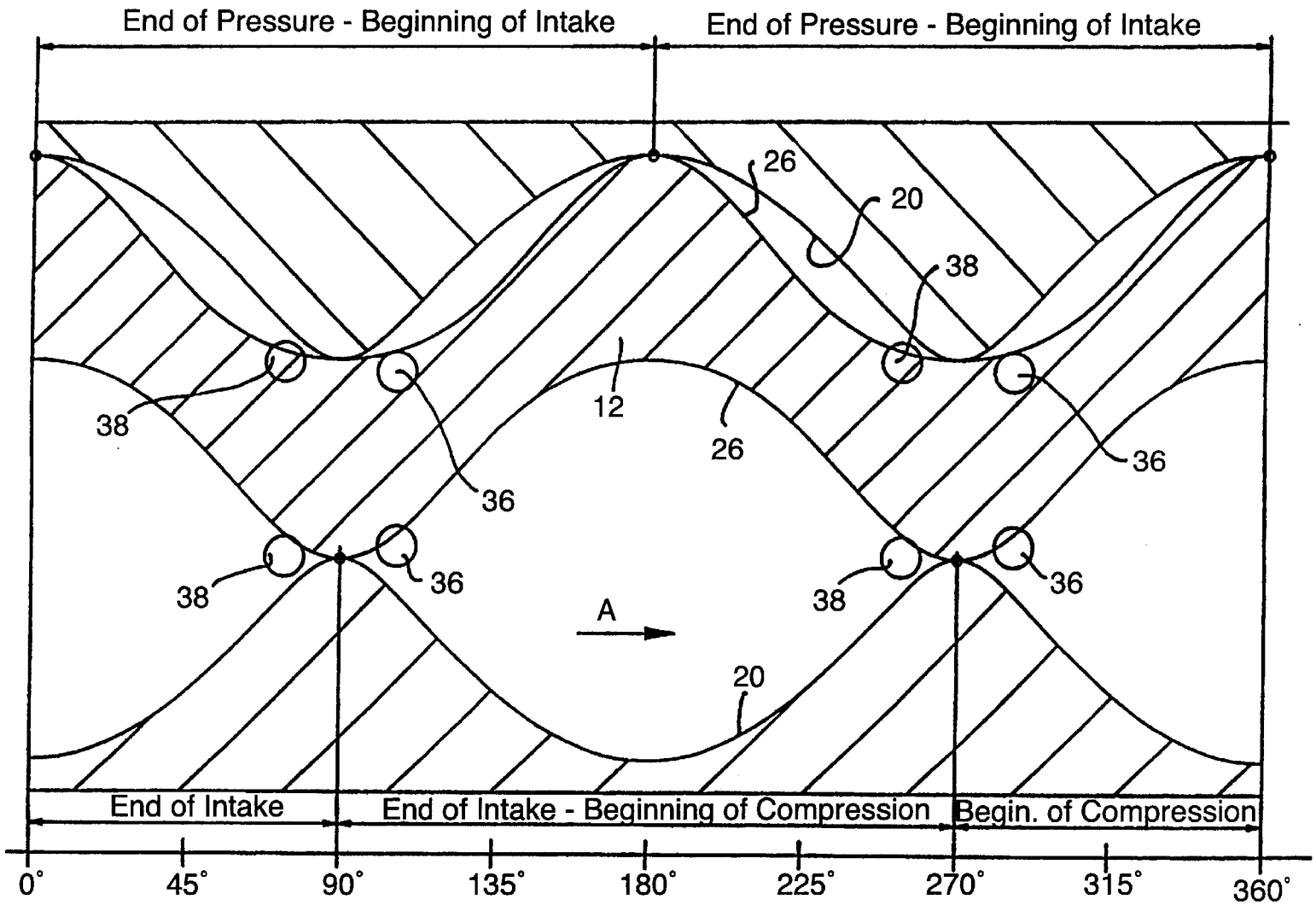
Figure 12:
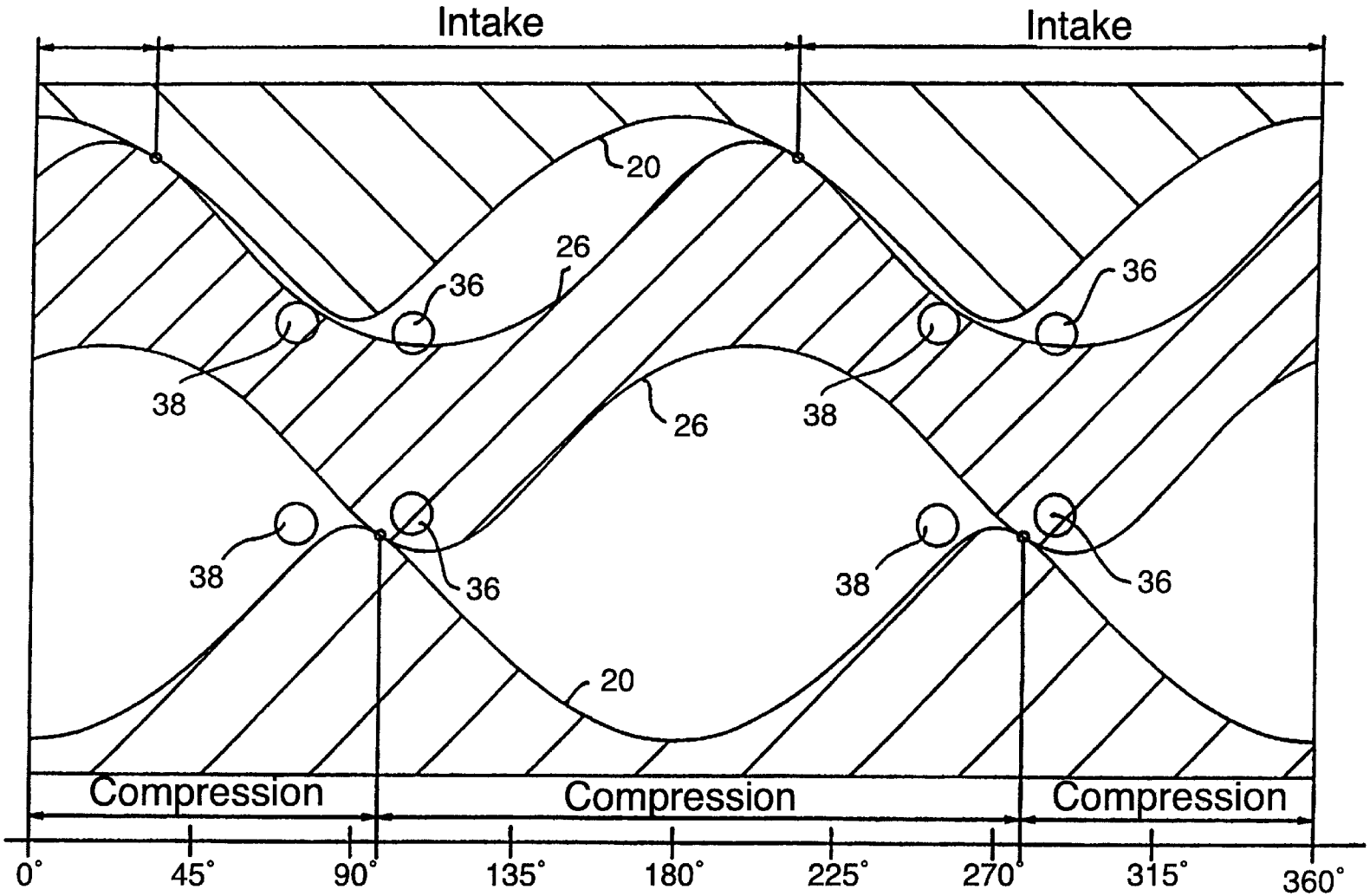
Figure 13:
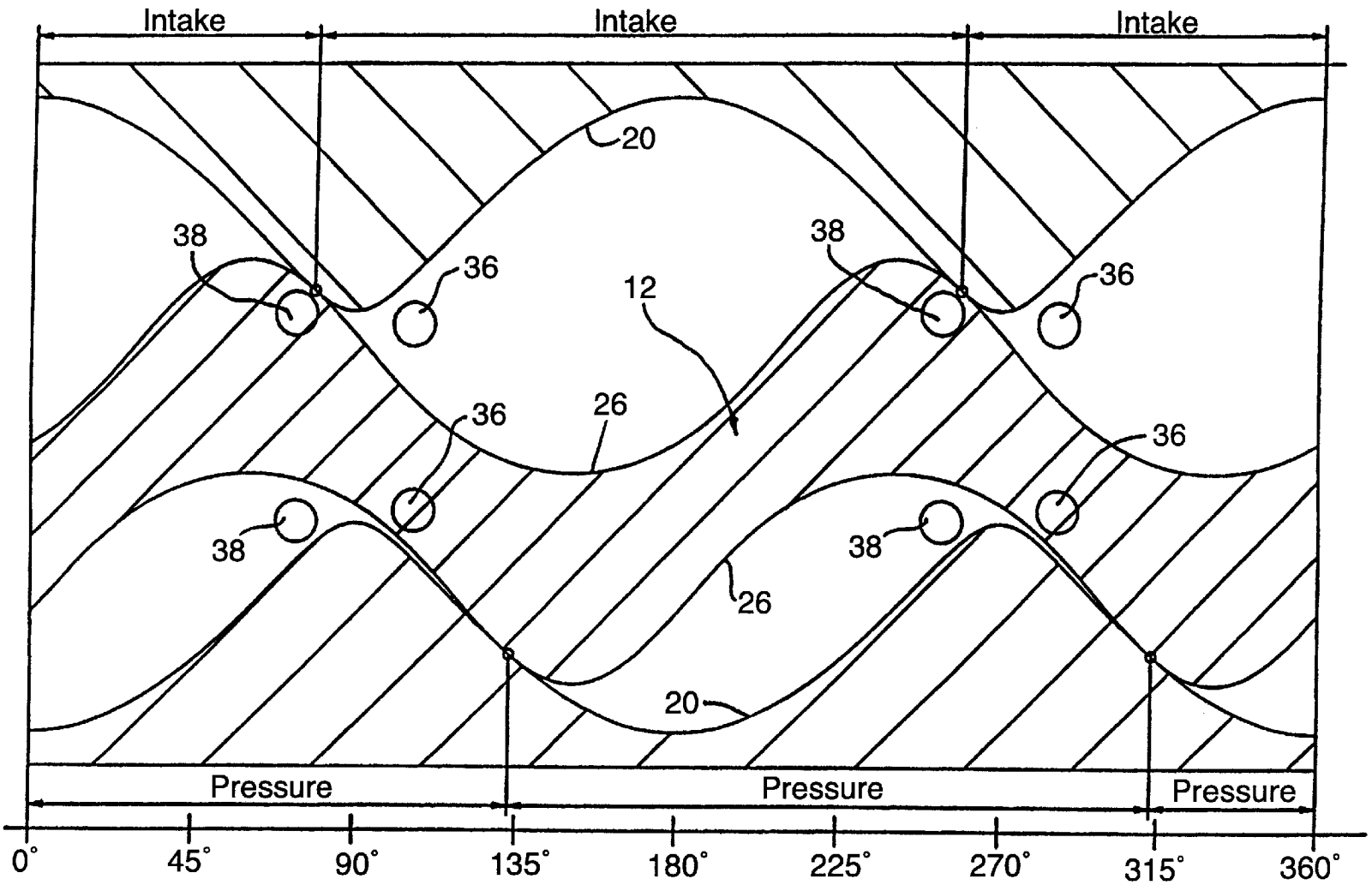
Figure 14:
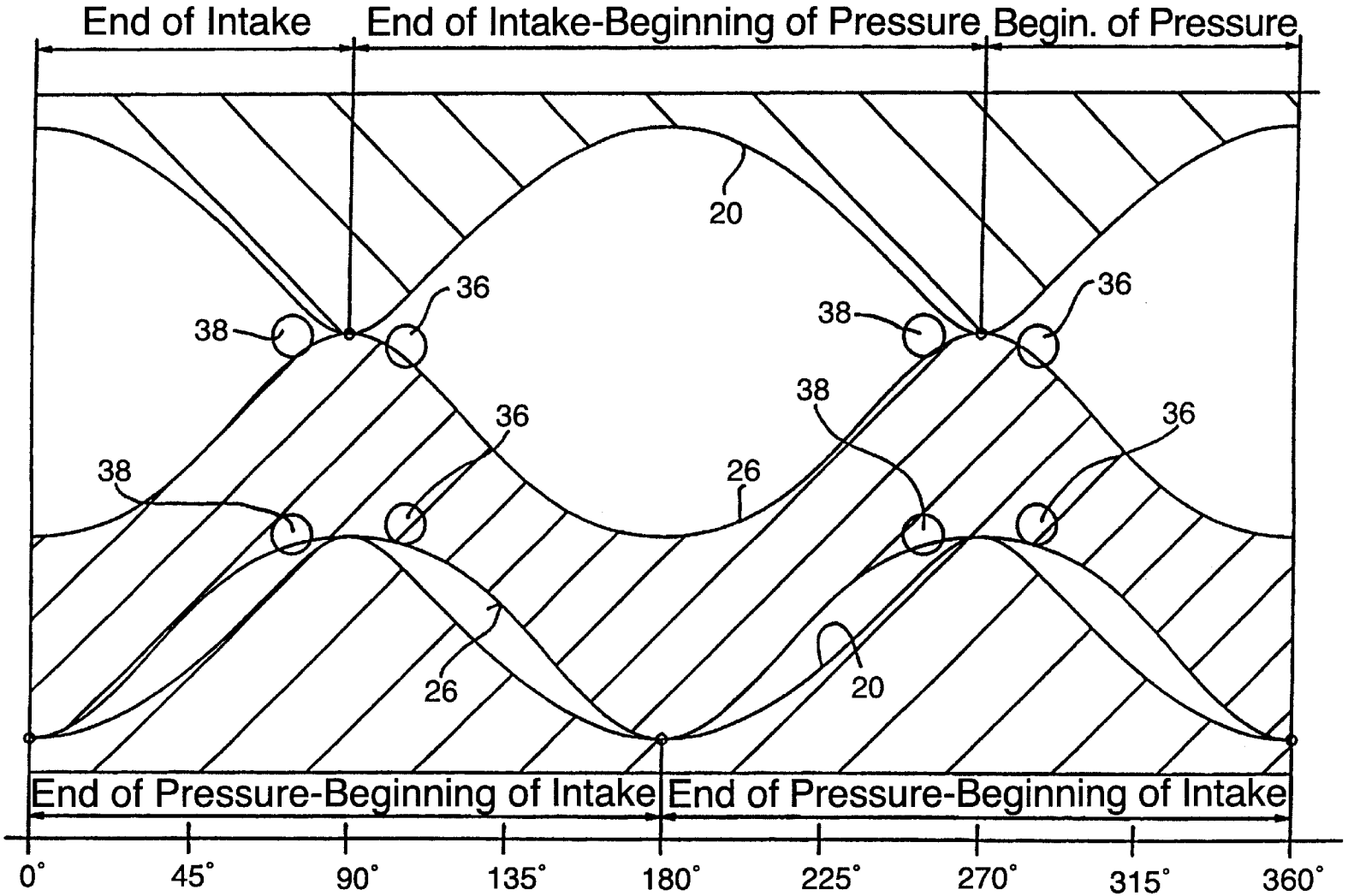
Figure 15:
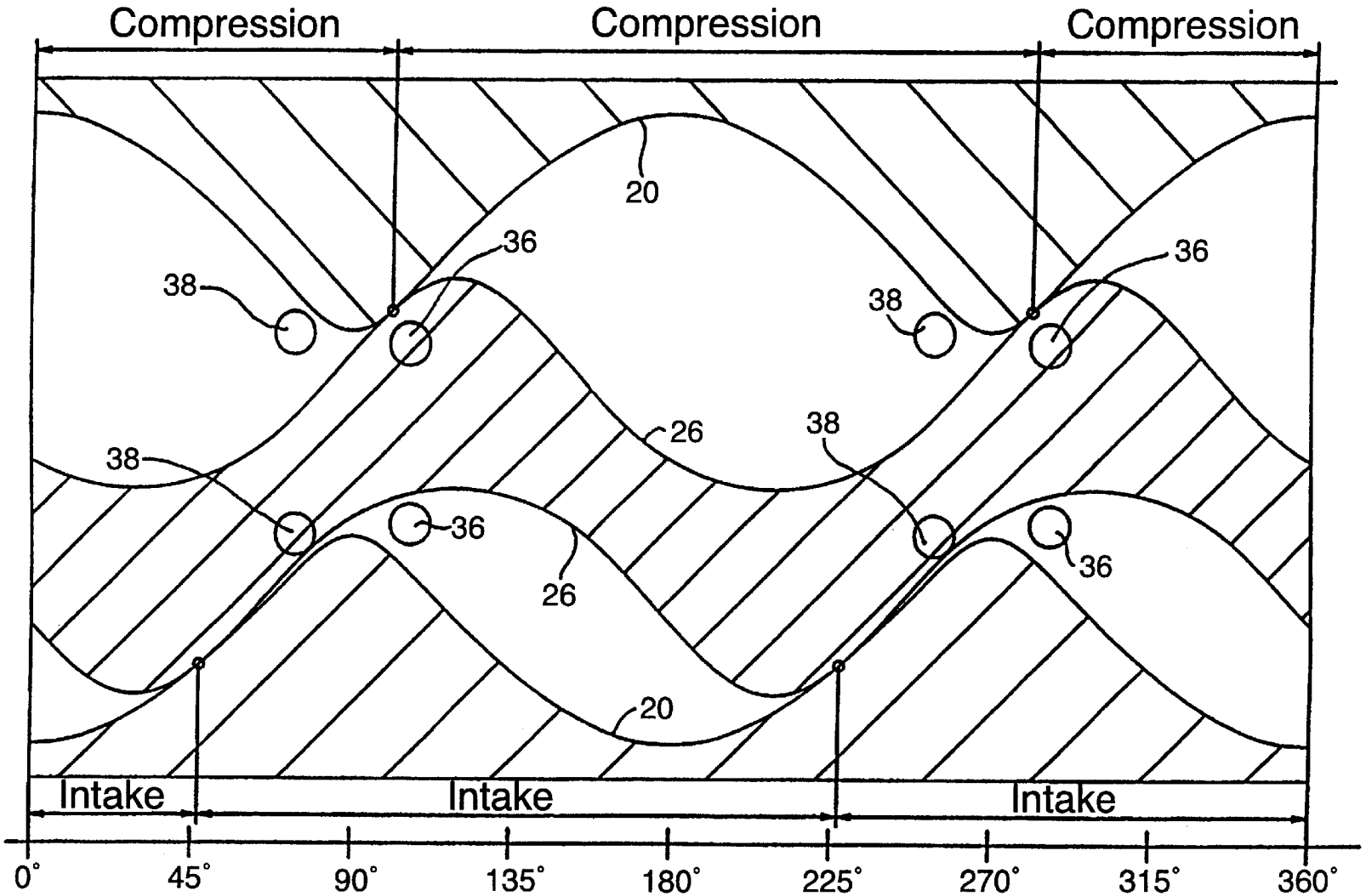
Figure 16:
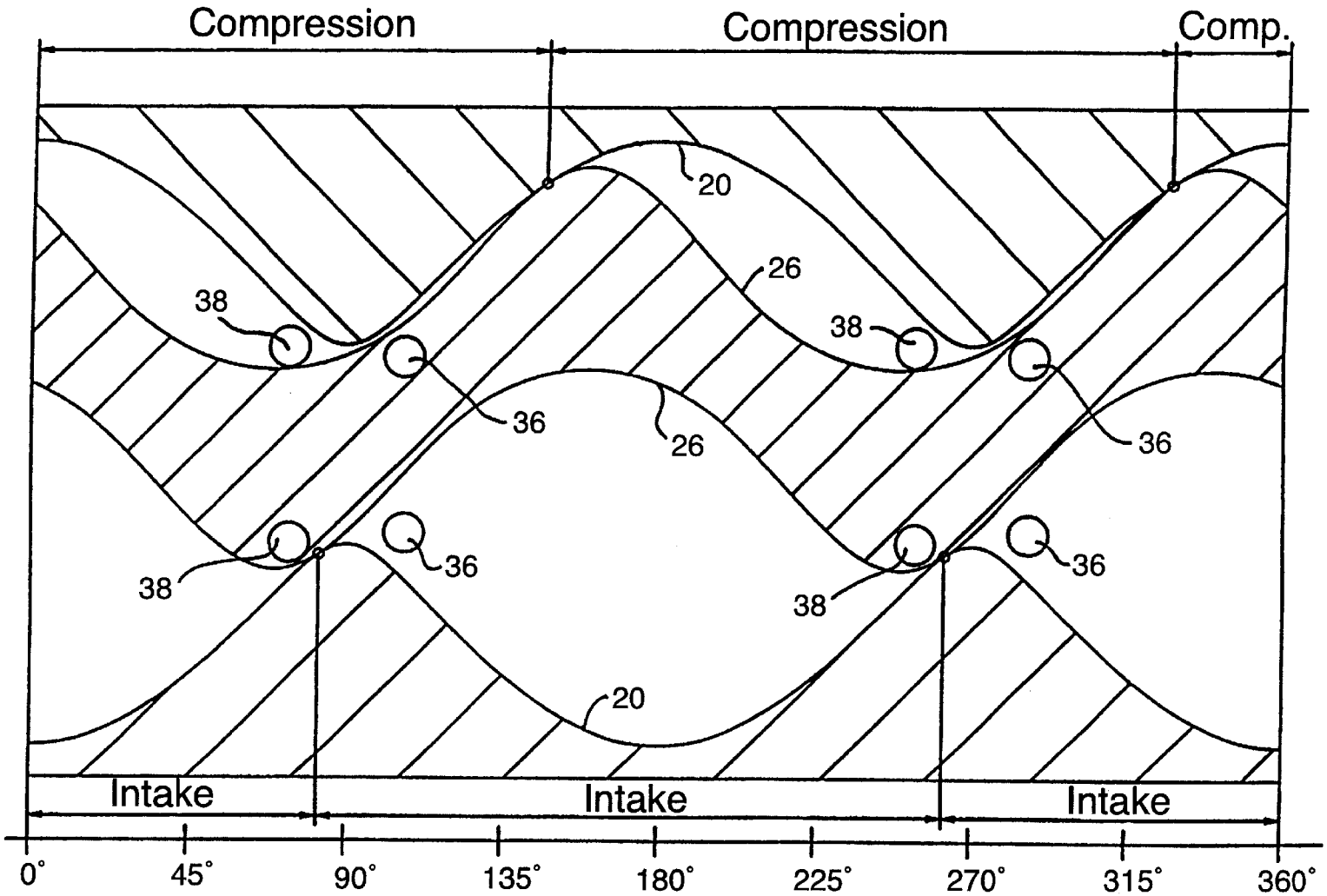

FIG. 6 shows the previously indicated process with a rotation of the piston 12 in the direction of the arrow A relative to the stationary housing 10. The upper inlet opening at 36 is now open, so that the mixture can now be drawn in. The outlet opening 38 is closed. The combustion space is enlarging with the expanding combustion gases. In the lower portion, the outlet channel is entirely open so that the combusted gases can be exhausted, while the inlet opening is closed and thereby a compression is possible in the involved region. FIG. 8 shows the position inverse to that of FIG. 5, that is the piston 12 with respect to the upper end surface 20 of the annular space 14 is in its lower dead point position and with respect to the lower end surface 20 of the annular surface 14 is in its upper dead point position. At FIG. 10 the condition illustrated in FIG. 5 begins again, at which the piston 12 has carried out one revolution relative to the housing and therewith has gone through the four steps of the motor, namely suction, compression, combustion and exhaust.

It will be recognized that it is possible to control the inlet and outlet openings entirely without valves and by the piston itself, and that except for the rotating and axially oscillating piston and the shaft, no further moveable parts are required. Especially no movable sealing elements are required. Since the piston is formed entirely symmetrically, no unbalanced forces appear, to disturb the bearings or the shaft.

FIGS. 11–16 show the same phases for a rotary piston machine formed as a pump. Since in this case there are only two steps per work stroke, namely suction and exhaust, two pairs of inlet openings 36 (suction conductors) and outlet openings 38 (pressure conductors) can be provided. Moreover, the operating phases of the two piston/annular space arrangements are again in the same way displaced 180° from one another, as has already been described for the case of the motor according to FIGS. 5–10.

It is claimed:

1. A rotating piston machine with a housing (10) and a piston (12) which piston is rotatably arranged in a hollow space of the housing (10) and is rotatably fixedly connected to a shaft (18) passing through the housing, with the housing (10) having at least one inlet and one outlet channel (32) for the delivery and exhaust of a working fluid to and from the hollow space, characterized in that the hollow space has the shape of a section of a cylindrical annular space (14) coaxial to the shaft (18) and defined by a coaxially extending radially outer boundary wall and a coaxially extending radially inner boundary wall of the housing, that the piston (12) is formed as an annular piston in the shape of a cylindrical tube section, which piston is received in the annular space (14) of the housing (10) and is guided for axially shiftable movement, and that the end surfaces (20, 26) of the annular space (14) and of the annular piston (12) which face one another are formed as continuous wave surfaces with amplitudes directed parallel to the machine axis, wherein inlet and outlet openings (36,38) lie in at least one of the boundary walls of the annular space, within an axial region defined adjacent each axial end of the piston by the maximum axial spacing of the end surfaces (20,26) facing one another.

2. A rotary piston machine according to claim 1, further characterized in that the continuous wave surfaces define at least two wave crests (22,28) and two wave hollows (24,30) for each 360° of the circumference, with the half width of the wave crests (38) measured in the circumferential direction of at least one of the end surfaces being smaller than the wave hollows (30) of the same end surface.

3. A rotary piston machine according to claim 2, further characterized in that in a case of use of the machine as a pump at least two inlet openings (36) and two outlet openings (38) are provided for each end surface of the piston (12).

4. A rotary piston machine according to claim 1, further characterized in that the piston (12) is axially slidably supported on the shaft (18).

5. A rotary piston machine according to claim 1, further characterized in that the piston (12) is rigidly connected with the shaft (18) and that the shaft is axially slidably supported in the housing (10).

6. A rotary piston machine according to claim 1, further characterized in that the piston (12) is biased in the direction toward the end surface (20) of the annular space (14).

7. A rotary piston machine according to claim 1, further characterized in that a groove (33) is formed in a lateral surface of the piston (12) or of the annular space (14), in which groove is received a guide element (35) connected to the other part (annular space 14, piston 12), with the path of the groove in the circumferential direction corresponding to the wave shape of the end surface (20) of the annular space (14).

8. A rotary piston machine according to claim 1, further characterized in that in one of the end faces (20,26) of the annular space (14) and the piston (12) a guide element (37) is rotatably supported for rolling engagement on the other of the end surfaces.

9. A rotary piston machine according to claim 1, further characterized in that the inlet opening (36) and the outlet opening (38) are arranged in the circumferential direction before and behind a wave crest (22) in the end surface (20) of the annular space (14).

10. A rotary piston machine according to claim 1, further characterized in that the inlet opening and/or the outlet opening is provided at the radially inner boundary wall (15) of the annular space (14).

11. A rotary piston machine according to claim 1, further characterized in that one of the end surfaces (20,26) which come in contact with one another is formed sinusoidally.

12. A rotary piston machine according to claim 1, further characterized in that two annular space/annular piston arrangements (14,12) according to claim 1 are so arranged relative to one another, that the two pistons arranged on the same shaft (18) move in common between the end surfaces (20) of the two annular spaces (14).

13. A rotary piston machine according to claim 12, further characterized in that the two pistons are formed as a one piece double-piston (12).

14. A rotary piston machine according to claim 12, further characterized in that the maximums and minimums of the two identically formed end surfaces (20) of the annular space (14) each lie on the same generatrix of the cylindrical lateral surface of the annular space of (14), and in that the maximum (28) of one end surface (26) of the two pistons (12) lies in common with a minimum (30) of other end surface (26) on a generatrix of the lateral surface of the piston.

* * * * *